US005899349A

United States Patent [19]

Moore

[11] Patent Number: 5,899,349

[45] Date of Patent: May 4, 1999

[54] CAP/CLOSURE HAVING A VENTING MECHANISM FOR USE WITH CENTRIFUGE CONTAINERS

[75] Inventor: Patrick Q. Moore, Gilroy, Calif.

[73] Assignee: Beckman Instruments, Inc., Fullerton, Calif.

[21] Appl. No.: 08/942,973

[22] Filed: Oct. 2, 1997

[51] Int. Cl.[6] ..... B04B 15/00; B65D 51/18; B65D 51/16

[52] U.S. Cl. ..... 215/277; 215/307; 215/308; 215/DIG. 3; 604/319; 494/16

[58] Field of Search ..... 215/270, 271, 215/262, 277, 307, 308, 314, 320, 321, 329, 354, 355, 364, DIG. 3; 220/367.1, 371, 372, 373, 203.05, 203.06; 604/403, 317, 319; 600/573; 494/16, 85

[56] References Cited

U.S. PATENT DOCUMENTS

| | | | |
|---|---|---|---|
| 718,643 | 1/1903 | Lees . | |
| 3,339,772 | 9/1967 | Miller | 215/307 X |
| 3,924,772 | 12/1975 | Magnani . | |
| 4,076,170 | 2/1978 | Chulay et al. . | |
| 4,080,175 | 3/1978 | Chulay et al. . | |
| 4,304,356 | 12/1981 | Chulay et al. . | |
| 4,844,273 | 7/1989 | Hawkins . | |
| 5,127,895 | 7/1992 | Pawlovich . | |
| 5,291,783 | 3/1994 | Hall . | |
| 5,325,977 | 7/1994 | Haynes et al. . | |
| 5,361,922 | 11/1994 | Moore et al. . | |
| 5,395,001 | 3/1995 | Moore . | |
| 5,458,252 | 10/1995 | Logel . | |
| 5,499,735 | 3/1996 | Chen . | |
| 5,732,837 | 3/1998 | Jones | 215/308 X |

FOREIGN PATENT DOCUMENTS

| | | | |
|---|---|---|---|
| 4247/26 | 10/1926 | Australia . | |
| 662110 | 8/1929 | France | 215/307 |
| 1159634 | 6/1958 | France | 215/307 |
| 717393 | 9/1939 | Germany | 215/314 |
| 354683 | 5/1961 | Switzerland | 215/307 |
| 943323 | 12/1963 | United Kingdom | 215/314 |

*Primary Examiner*—Stephen K. Cronin
*Assistant Examiner*—Nathan Newhouse
*Attorney, Agent, or Firm*—William H. May; P. R. Harder; Thomas Schneck

[57] ABSTRACT

A cap assembly for use with a centrifuge container includes a stopper (plug) member to provide a fluid-tight seal of an open end of the container. The stopper member includes a channel therethrough. A lid receives the combination of a stopper fitted into the open end of the container. Depending portions on the underside of the lid press upon the stopper to ensure a reliable seal of the container. In addition, the depending portions are adapted to close off an opening of the channel when the lid and stopper are assembled. Removal of the lid opens the channel allowing air to flow into the container, and in this way any vacuum that develops in the container during a centrifugation run is released by such action.

12 Claims, 7 Drawing Sheets

CAP/CLOSURE HAVING A VENTING MECHANISM FOR USE WITH CENTRIFUGE CONTAINERS

TECHNICAL FIELD

The present invention pertains to the field of centrifugation. Specifically, the present invention pertains to an improved capping assembly for removable sample-holding containers employed in centrifuges.

BACKGROUND ART

Centrifuges are commonly used in medical and biological industries for separating and purifying materials of differing densities, such as viruses, bacteria, cells and proteins. A centrifuge includes a rotor and a container to support a sample undergoing centrifugation. The rotor is designed to hold the sample container while it spins up to tens of thousands of revolutions per minute. To avoid spillage, evaporation, or aerosoling of the sample, a cover is placed onto the container so as to provide a fluid-tight seal therebetween During centrifugation, hydrostatic pressure within the container can compromise the seal integrity of the covered container. The hydrostatic pressure may force the sample to pass between the cover and the receptacle. Avoiding this type of leakage poses a great challenge when designing centrifuge sample containers. The prior art is replete with differing designs for sample-holding containers from which inspiration may be drawn to provide improved sample-holding centrifuge containers.

U.S. Pat. No. 718,643 to Lees et al. discloses a sealing-jar for preserving articles of food, FIG. 1, including a body of a receptacle (a), a recess (b), a cover (c), a flat flange (d), a circular down-turned rib (e), and a rubber gasket (f). A seal is achieved by the gasket (f) fitting around the cover (c), beneath the flange (d), so as to bear against the recess (b), but this seal is easily compromised by centrifugal forces.

Australian Pat. No. 4247/26 to Lucke et al. discloses an apparatus for sealing bottles and jars, FIGS. 1–3, containing a domed disc stopper 8 having a downwardly projecting wall 9 near its outer edge. The wall 9 is inclined to match the seating 7 at the top of a rigid neck 5 of a jar or bottle. A rigid cap 12 has internal screw-threads 6 that are designed to thread onto the neck 5. A resilient ring 10 fits into an annular groove in the face of the stopper, col. 3 lines 4–8. The resilient ring 10 seats against the neck 5 by the cap 12 pressing against the stopper 8.

U.S. Pat. No. 3,924,772 to Magnani et al. discloses an airtight container cap, FIGS. 1–3, containing a ring-nut 1 have an upper circular hole 2, a slot 3 on the side surface thereof and threads 4; a jar 7 with a threaded neck 6; glass stopper 8 having one groove 9 in the upper portion a second groove 10 in the lower portion and a shoulder 12; and a circular gasket 11. The circular gasket 11 is positioned within groove 10 of the glass stopper 8. The glass stopper 8 is then mounted inside of ring-nut 1 through hole 2. Ring-nut 1 is then threaded onto the neck 6 of a jar 7, forming a hermetic seal.

U.S. Pat. No. 4,844,273 to Hawkins et al. discloses a closure with enhanced sealing for a container, FIGS. 1–3, comprising a container neck lip 30 and a cap 18 having an inner skirt 24, a top 20 and a depending coaxial outer skirt 22. The outer skirt has internal threads 26 for engaging the complementary external threads 28 of the container neck. The inner skirt 24 has an interference fit with the inside of the container neck lip 30, thus, forming one element of the enhanced seal. A bead 32 projects inwardly from the depending skirt 22 and provides the second element of the enhanced seal by maintaining peripheral contact against the outside of the container neck lip 30. An o-ring 34 is positioned between the outer and inner skirts, 22 and 24 respectively, and becomes compressed between the top 20 and the container lip 30 to maintain a hermetic seal while the cap 18 is threaded on the container neck 12. The rigid inner skirt firmly presses against the inside of lip 30 and co-acts with the inwardly directed bead 32 maintaining peripheral contact with the outside lip 30, which helps to maintain the hermetic seal by retaining the o-ring 34 in its compressed state.

U.S. Pat. No. 5,291,783 to Hall discloses a tube 10 for use in a fixed angle centrifuge rotor having indicia 20 thereon indicating the level to which the tube may be filled with liquid without risk of spillage due to meniscus re-orientating.

U.S. Pat. No. 5,325,977 to Haynes et al. discloses a vented closure for a capillary tube assembly 10. The assembly 10 includes a capillary tube 12 having a bore extending therethrough and a cap 14 slidably mounted to on end of the tube 12. The cap 14 includes an enlarged head 16 and a substantially cylindrical body 18. One or more vent grooves 20 are formed into the body which allows air to escape when the cap 14 is in a first slidable position. The groove 20 typically extends parallel to the longitudinal axis of the cylindrical body 18.

U.S. Pat. No. 5,458,252 discloses an invertible pressure-responsive sealing cap I for attachment to a container 2 having a mouth 4 with an outwardly facing threaded portion 12. The mouth 4 has an inner cylindrical sealing surface 6. The cap 1 has a threaded portion 3 disposed on a cap skirt 5, with the threaded portion 3 facing inwardly toward a cap axis 7. A central dome portion 9 is symmetrically disposed about the cap axis 7 and extends outwardly therefrom, terminating in an annular portion 11. The dome portion 9 is initially concave and extends into the mouth 4 of the container 2. The interface of the dome portion 9 and the annular portion 11 define a first flexure area 17. A sealing portion 13 is disposed about the annular portion 11 defining a second flexure area 21 thereat. The sealing portion 13 includes an outwardly facing cylindrical surface 23. In operation, the cap 1 is mated to the container 2 and pressure build-up therein causes the dome portion 9 to flatten increasing the sealing force between the sealing surfaces 23 and 6. A drawback with the aforementioned containers is that the fluid-tight integrity of the seals is compromised by samples egressing therethrough during centrifugation, which has led to the development of seals which employ centrifugal force to drive a cap or plug against a container.

U.S. Pat Nos. 5,127,895 to R. Pawlovich; 5,395,001 to P. Moore; 5,361,922 to P. Moore et ale; 4,304,356 to S. Chulay et ale; 4,290,550 to S. Chulay et ale; 4,080,175 to S. Chulay et al.; and 4,076,170 to S. Chulay et al. ale, all assigned to the assignee of the present invention, disclose centrifuge containers which achieve a seal by having a cap or plug forced against a container under centrifugal force. In some of these patents, deformable o-rings are used as part of the seal mechanism. Tapered surfaces, annular ridges and annular grooves are all employed, as in U.S. Pat. No. 5,395,001, to achieve a sealed sample.

For centrifuge containers having large diameter openings, structural flexure of the sample containment assembly during a centrifugation run may permit air to pass from within the container. Thus, a container having a lid for sealing its open end will be subject to a small but significant negative air pressure as a result of the venting of air from the container. This presents operational difficulties to the lab technician who must contend with carefully removing the vacuum sealed lid without doing damage to it, and yet desires to rapidly perform the operation in order to minimize the down time between centrifugation runs.

What is needed is a capping assembly for a centrifuge container that is capable of maintaining a tight seal during a centrifugation run while at the same time is capable of easily releasing a vacuum that may develop within the container during the run. It is desirable that such a capping assembly be manufactured with minimum parts and easily maintained during its useful life.

SUMMARY OF THE INVENTION

A capping assembly for a centrifuge container features a stopper (or plug) for being received within the opening of the container in order to provide a fluid-tight seal. A lid member (or cap/closure) receives the combination stopper/container to hold the stopper in place to maintain the fluid-tight seal. The lid member includes depending portions which contact an upper surface of the stopper to provide a pressing force upon the stopper. The stopper includes a venting channel formed therethrough, with an upper orifice opening through the top surface of the stopper and a lower orifice opening through the bottom surface of the stopper. When assembled, the depending portions of the lid contact top surface of the stopper, pressing down on the stopper and closing off the upper orifice. When disassembled, the depending portions of the lid lift off from the top surface of the stopper and open the upper orifice. This permits air flow into the container to release any vacuum that may have developed during a centrifugation run.

In a preferred embodiment, the stopper includes a centrally located boss member depending from the bottom surface of the stopper. The venting channel passes through the boss member, opening through the bottom end of the boss. A gasket is disposed within a gland circumferentially formed about the channel opening.

In a variation of the present invention, the channel has an inverted funnel-shaped cross-section so that the end of the channel opening into the container is wider than the other end. This is preferable configuration because it appears to lower the likelihood of fluid collecting along the walls of the venting channel.

In another variation of the present invention, the stopper includes a filter (or membrane) element disposed along the fluid path of the channel.

BRIEF DESCRIPTION OF THE DRAWINGS

FIG. I is an exploded perspective view of the capping assembly employed in a dual-vessel removable sample-holding centrifuge container, in accord with the present invention.

BEST MODE FOR CARRYING OUT THE INVENTION

Figure 1:
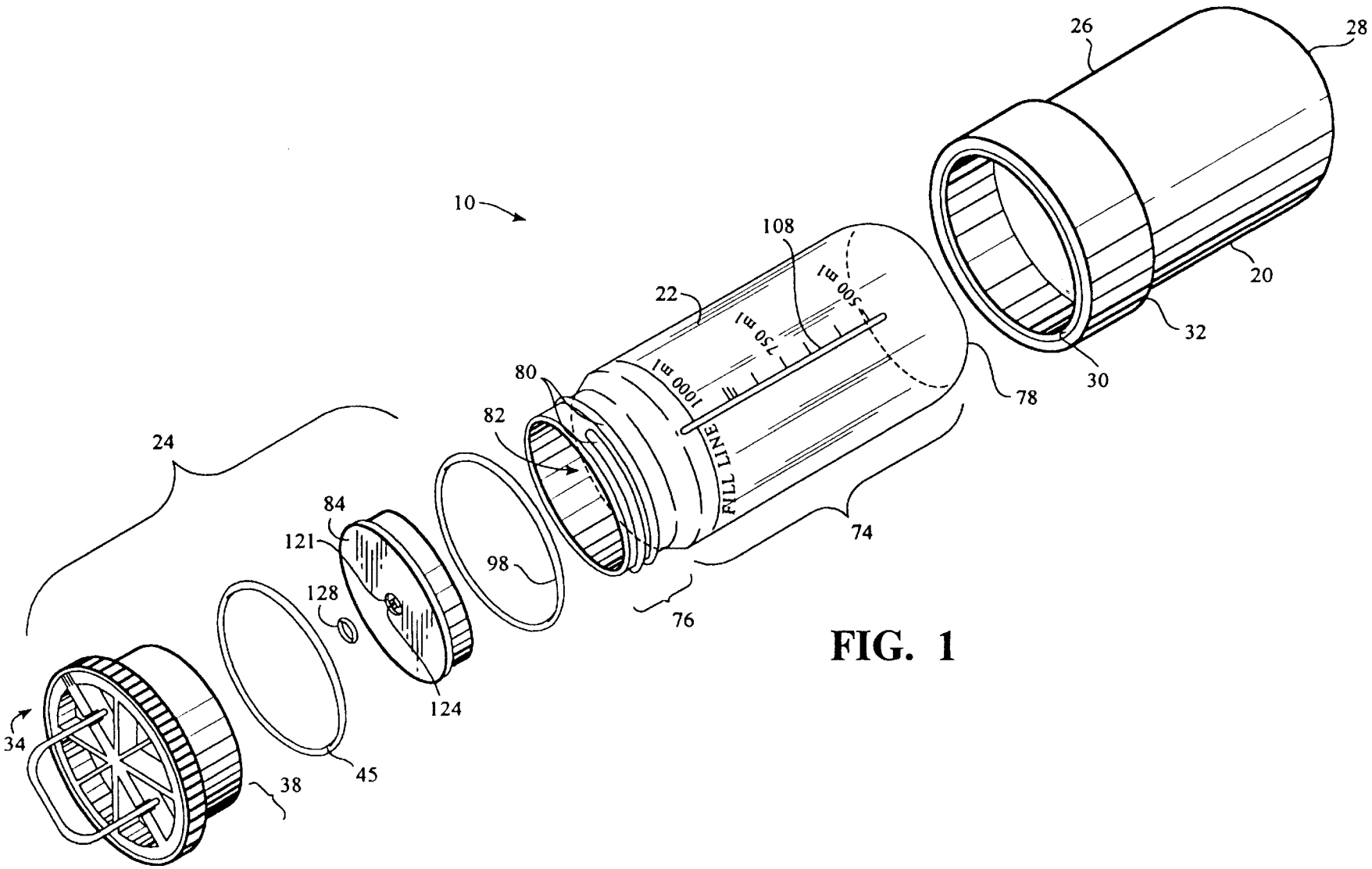
Figure 2:
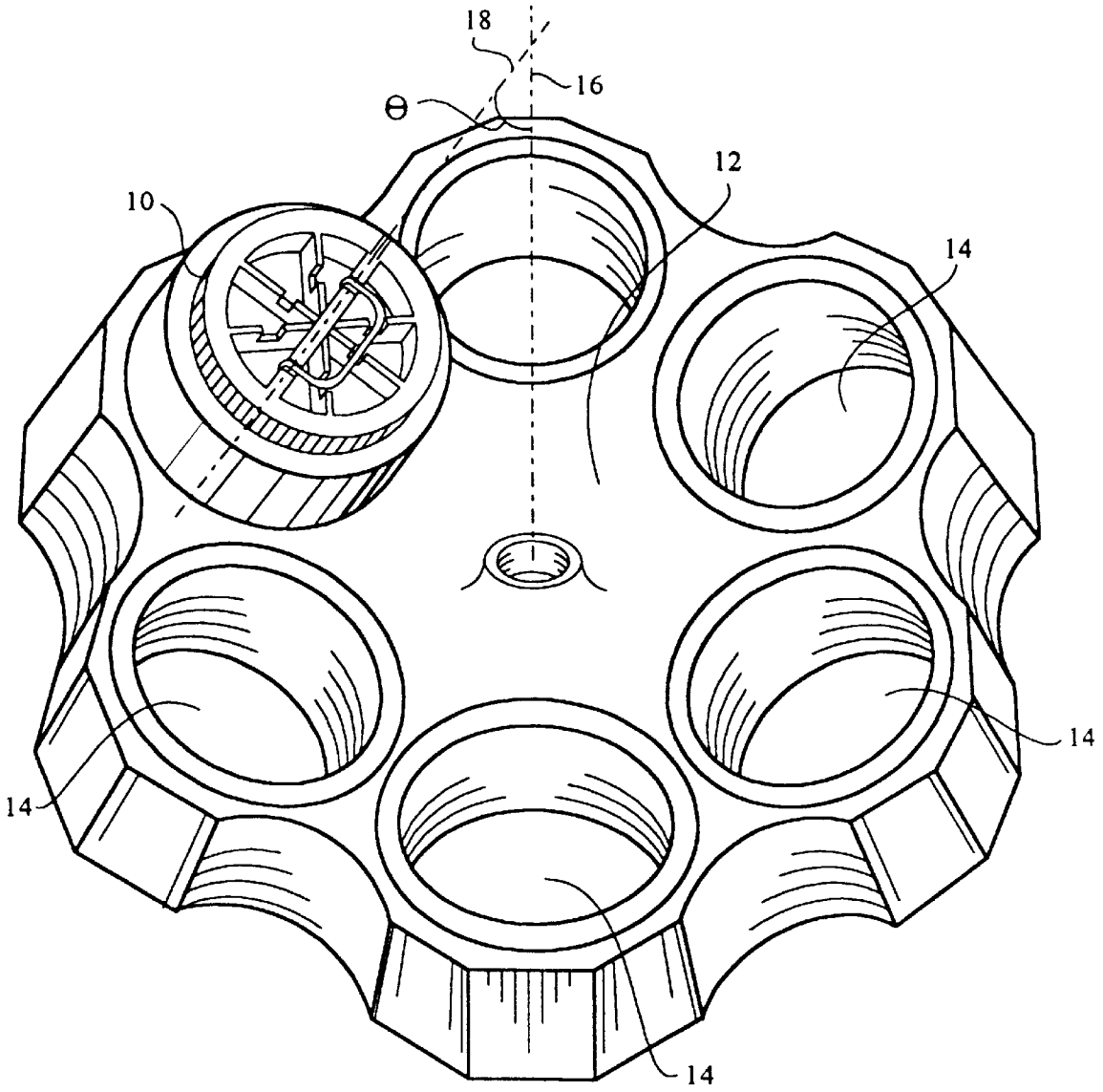
FIG. 2 is a perspective view showing a dual-vessel removable sample-holding centrifuge container of FIG. 1 placed in a centrifuge rotor, in accord with the present invention.

With reference to both FIGS. 1 and 2, a dual vessel centrifuge container 10 is shown for use in a fixed-angle centrifuge rotor 12 of the type having a plurality of bores 14 disposed radially symmetric about the rotor 12's spin axis 16. In fixed angle centrifuge rotor 12, a lengthwise axis 18 of the centrifuge container forms an angle θ, with respect to the spin axis 16. The centrifuge container 10 includes a canister 20, a receptacle 22 and a capping assembly 24. The canister 20 may be permanently fixed to the rotor 12 or be removably attached thereto and have any cross-sectional area desired. For clarity, the canister 20 will be discussed as being removably attached to the rotor 12 and having a circular cross-sectional area defined by a cylindrical wall 26 that extends from a closed end 28, terminating in an open end 30. Protruding from the cylindrical wall 26, between the closed end 28 and the open end 30, is an annular shoulder 32. Each of the bores 14 is shaped to receive the canister 20 so that the shoulder 32 rests against the rotor 12.

Referring to FIGS. 1, 3, 4A, 4B and 5, the capping assembly 24 includes a lid 34 having a cover portion 36 and a peripheral member 38, surrounding the cover portion 36 and extending transverse thereto The cover portion 36 has first and second opposed major sides 40 and 42, respectively. The first side 40 has a convex shape, and the second side 42 has a concave shape. An upper portion 44 of the peripheral member 38 extends away from the second side 42, terminating in an annular rim 46 positioned to face the first major side 40. The upper portion 44 includes an inner 48 surface and an outer surface 50, disposed opposite to the inner surface 48. The inner surface 48 extends between an upper surface of the annular rim 46 and the first side 40. The outer surface 50 extends from the annular rim 46 toward the second major side 42, terminating at an area of the peripheral member 38 that is positioned opposite to the cover portion 36. The outer surface 50 has a frusto-conical shape and includes an annular recess 52 to receive a gasket, e.g. o-ring 45. The annular rim 46 projects outwardly beyond the outer surface 50 and may be roughened or knurled to facilitate gripping the same. A lower portion 54 of the peripheral member 38 extends away from the upper portion 44, terminating in an annulus 56 which faces the second major side 42. The lower portion 54 includes inside and outside surfaces, 58 and 60, respectively. The inside surface 58 extends between the second side 42 and the annulus 56. The outside surface 60 is contiguous with the outer surface 50, extending between the annular recess 52 and the annulus 56. The lower portion 54 includes a plurality of threads 62 that are present on the inside surface 58. It is preferred, however, that the plurality of threads 62 be disposed on the inside surface 58.

Figure 5:
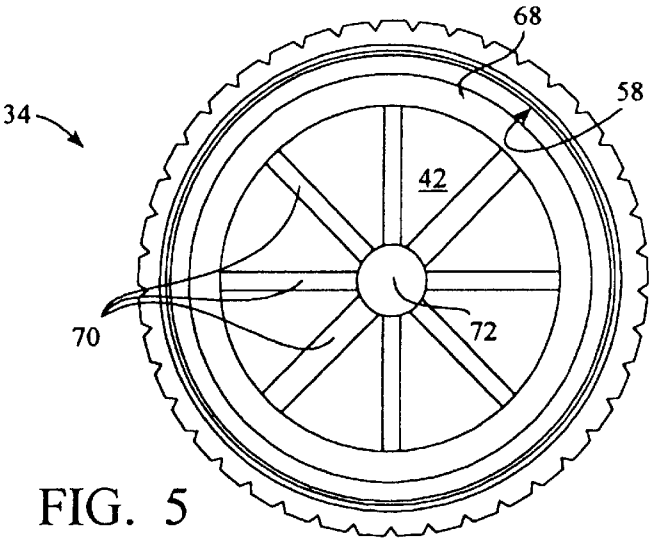
FIG. 5 is a bottom view of the lid shown in FIG. 3.
Figure 3:
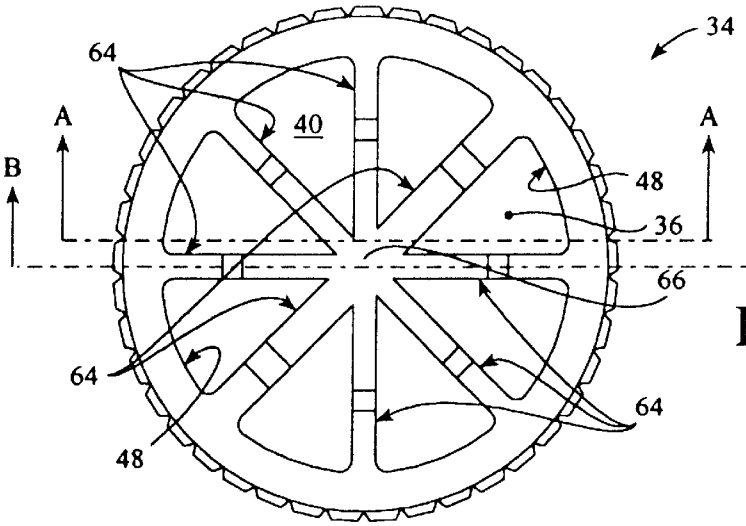
FIG. 3 is a top down view of a lid shown in FIG. 1.

Referring to FIGS. 3 and 5, a first set of arcuate ribs 64 extends across the first side 40, following the contour thereof. Each of the ribs 64 traverses the extent of the cover portion 36 between opposed areas of the inner surface 48. The ribs 64 of the first set intersect proximate to a center of the cover portion 36, forming an apex 66 thereat An annular contact ring 68 is disposed on the second major side 42 so as to be proximate to the inside surface 58 of the lower portion 54. A second set of ribs 70 extends across the second side 42, between opposed areas of the annular contact ring 68. The second set of ribs 70 are arcuate in that they follow the contour of the second side 42 and intersect proximate to a central contact area 72 of the cover portion 36. Each of the ribs 64 and 70 are adapted to flex, under a centrifugal load, expanding the peripheral member 38 outwardly, discussed more fully below.

The surfaces of annular contact ring 68 and central contact area 72 are substantially coplanar. This is shown in the cross-sectional view of FIG. 4B. This aspect of the invention will be discussed more fully below.

Figure 4B:
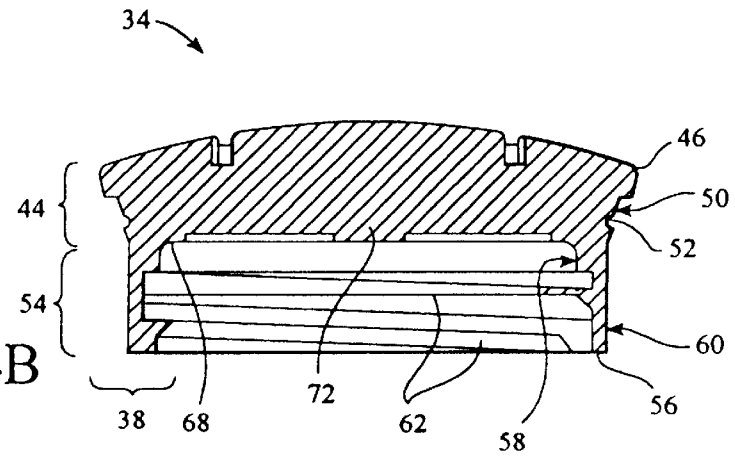
FIGS. 4A and 4B are cross-sectional views of the lid shown in FIG. 3 taken along view lines A—A and B—B respectively.
Figure 4A:
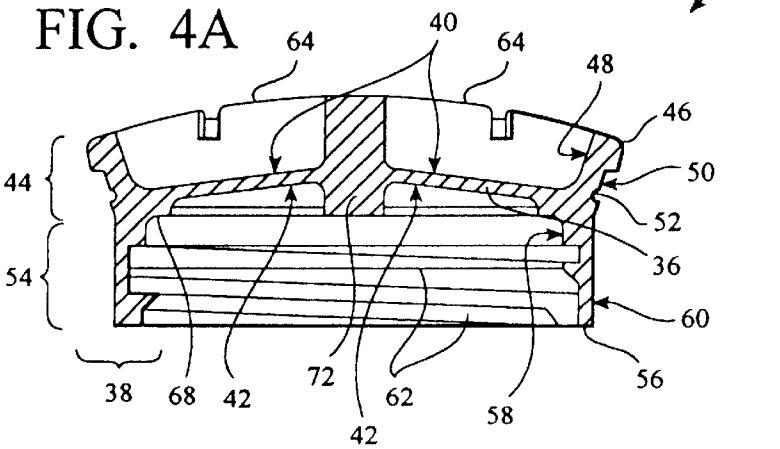

Referring to FIGS. 1, 4A and 4B, the receptacle 22 may be formed of any polymeric material which can be molded to include a tubular portion 74 extending from a threaded neck portion 76, terminating in a closed nadir 78. The inside diameter of the tubular portion 74 varies along the length thereof, providing the inside surface of the tubular portion 74 with a gradual taper. Specifically, the inside diameter of the tubular portion 74 is smallest proximate to the neck portion 76 and gradually increases so as to be largest proximate to the nadir 78. This eases the removal of a sample therefrom by facilitating access thereto by a spatula (not shown) or other device. Compared to the remaining portions of the receptacle 22, the neck portion 76 is provided with increased wall thickness, and therefore, increased strength, due to the gradual taper of the inside surface. The neck portion 76 includes a plurality of threads 8, and defines an open mouth 82. The plurality of threads 62 disposed on the inside surface 58 of the lower portion 54 are adapted to engage the plurality of threads 80 of the neck portion 76. In this fashion, the lid 34 threadably engages the receptacle 22, with the second major side 42 being positioned adjacent to the neck portion 76 when placed in the final seating position. To obtain fluid-tight and air-tight integrity between the lid 34 and the receptacle 22, a sealing device is disposed between the second side 42 and the neck portion 76. In accordance with the present invention, a stopper or plug member 84 serves as such a sealing device.

Referring to FIGS. 1 and 6A–6D, the stopper 84 has a first major surface 86 (top surface) and a second major surface 88 (bottom surface) disposed opposite to the first major surface 86, as well as a peripheral surface 90 extending therebetween. An annular depending portion 92 extends from the second major surface 88, away from said first major surface 86. The depending portion 92 extends from an area of the second major surface 88 which is spaced-apart from the peripheral surface 90, defining an annular flange 94. An annular shoulder 96 is provided, between the annular flange 94 and the depending portion 92, to receive a gasket 98, such as an O-ring. To ensure that the gasket 98 is retained on the stopper 84, a positive surface feature 99, such as a notch, is provided on the depending portion 92.

In accordance with the present inventions stopper 84 includes a centrally disposed boss 122 depending downwardly from bottom surface 88. A venting channel or through hole 124 extends axially through boss 122 from upper orifice 123 to lower orifice 125. Although not needed boss 122 is provided for additional structural support of channel 124. Stopper 84 further includes a gland 121 formed about orifice 123 of channel 124 for receiving a gasket 128. As will become clear in the discussion below, gasket 128 serves to provide an air-tight seal of channel 124 during a centrifugation run.

Figure 6A:
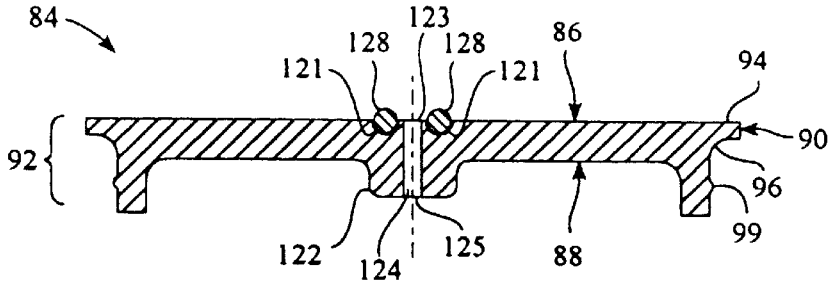
FIGS. 6A–6D are cross-sectional views of various embodiments of a stopper or plug shown in FIG. 1.
Figure 6B:
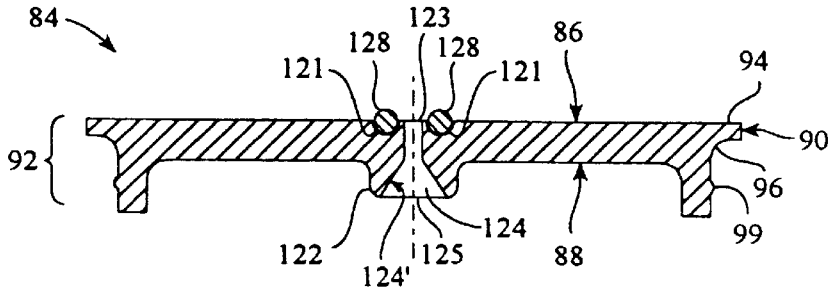

As can be seen in FIG. 6A, the width of channel 124 is constant along its length. FIG. 6B, however, shows a preferred embodiment of the invention wherein the width of channel 124 increases with approach toward lower orifice 125. The result is a channel having an inverted funnel-shaped cross-section. The conical feature of the channel reduces the potential for droplets to hang, adhere or otherwise collect on the interior surface 124. of the channel. The reduction of droplets forming on surface 124' is critical in situations where a positive pressure has developed in receptacle 22. Such a pressure differential will force air to escape from the receptacle and will pull any droplets present on surface 124' up and out of channel 124 and deposit such droplets onto top surface 86. The conical channel 124 of FIG. 6B serves to minimize the occurrence of such droplets.

Figure 6C:
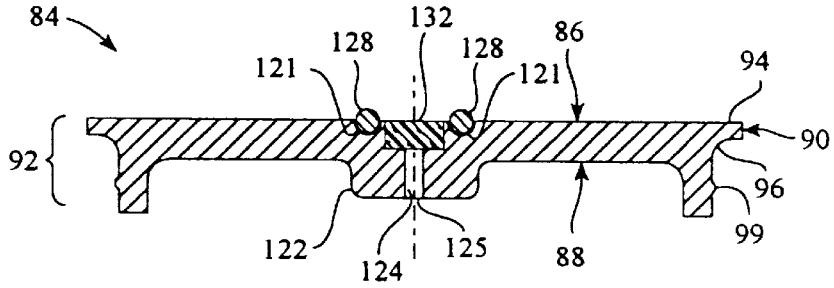
Figure 6D:
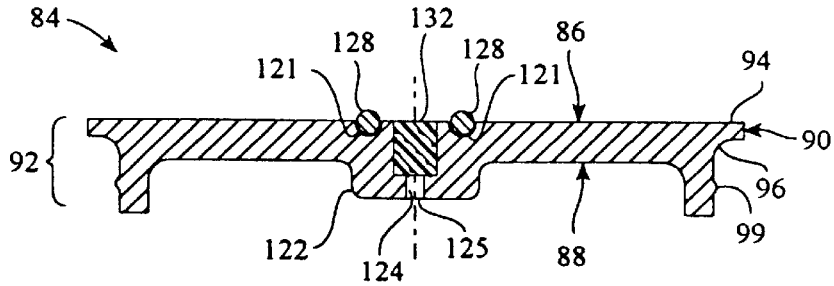
Figure 7:
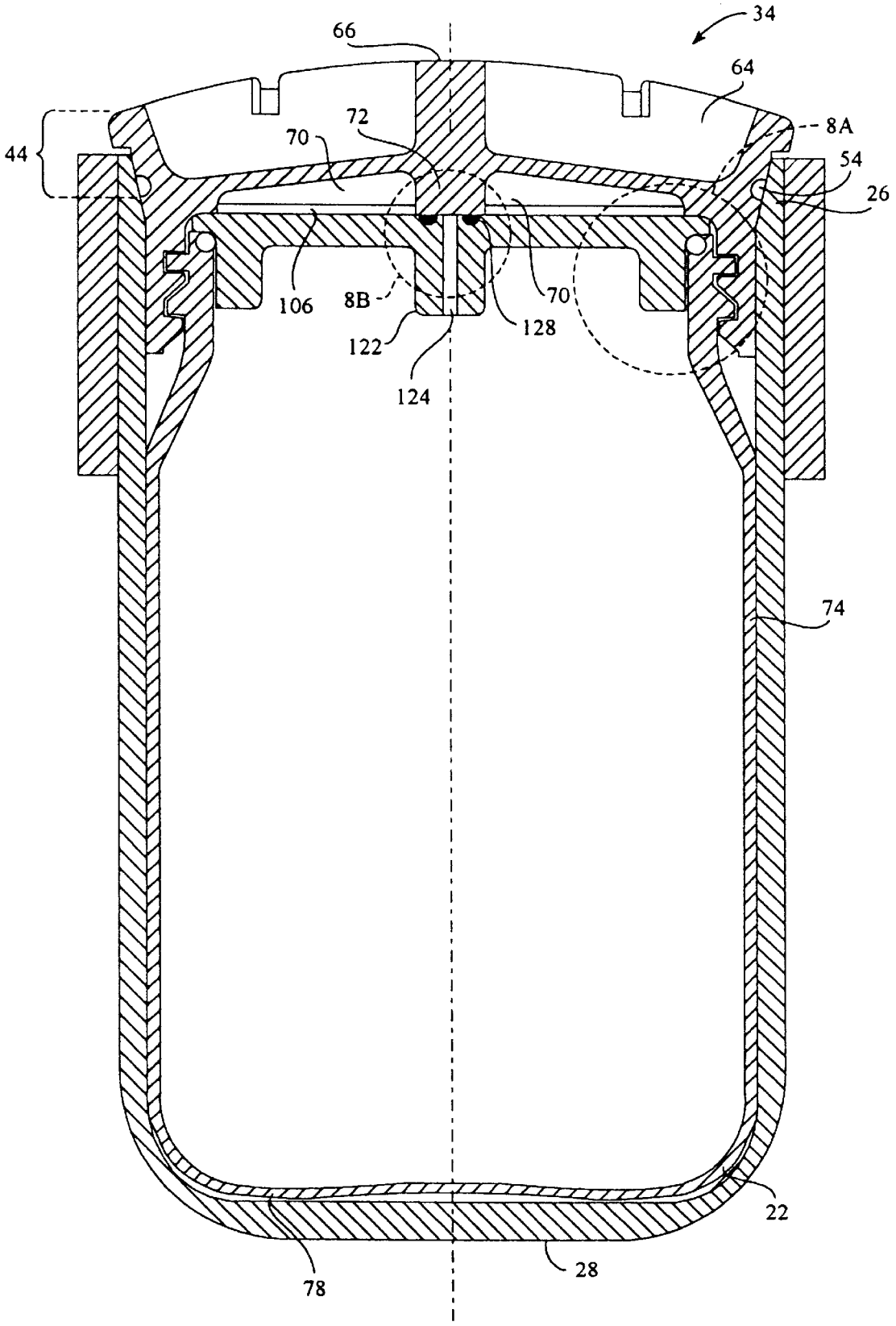
FIG. 7 is a cross-sectional view of the container shown in FIG. 1, with the capping assembly shown in a final seating position.

FIGS. 6C and 6D show an additional feature of the present invention, namely the incorporation of a filter (also known in the industry as a membrane) element 132 in the path of the channel FIGS. 6C and 6D show alternate placements of the filter element 132 in-line with the channel 124. Typically, the filter is a hydrophobic filter which can be mounted, press-fit, bonded, or otherwise fixed in position. Alternatively, the filter may be a replaceable component of stopper 84. Such filters are useful when there are concerns of aerosol contamination. These aerosols may be generated during the centrifugation run, on the lab bench, during which time the filter would prevent their escape from the receptacle and protect the user.

Referring to FIGS. 1, 2, 6A–6D, 7, 8A and 8B, in operation, the depending portion 92 of the stopper 84 is placed into the mouth 82 of the receptacle 22, and the lid 34 is threaded onto the neck portion 76, with the receptacle fitted into the canister 20 so that the frusto-conical surface 50 is seated against the cylindrical wall 26. To that end, the relative dimensions of the stopper 84 and the receptacle 22 are such that the depending portion 92 fits within the mouth 82. In this fashion, the gasket 98 is wedged against the neck portion 76, and the annular flange 94 approaches the upper edge 100 of the neck portion 76. To allow the gasket 98 to conform with the shape of the shoulder 96, while reducing the force necessitated to achieve the same, the neck portion 76 includes an arcuate gland 102. The arcuate gland 102 is formed into the neck portion 76 to extend from the upper edge 100, away from the plurality of threads 80. The shape of the gland 102 produces a rolling action, when the gasket 98 is compressed. The rolling action reduces the amount of force necessitated to distort and squeeze the gasket 98 into the appropriate shape to form a fluid-tight and air-tight seal between the stopper 84 and the receptacle 22. To facilitate the aforementioned compression, the annular contact ring 68 of the lid 34 is positioned to seat against the annular flange 94 of the stopper 84, directly above the gasket 98. The annular contact ring 68 is sized so as to extend toward the stopper 84 a further distance than the second set of ribs 70. In this fashion, the second set of ribs 70 are spaced apart from the first major surface 86, forming a void 106 therebetween.

By virtue of its axial alignment, central contact area 72 of lid 34 is in alignment with venting channel 124 of stopper 84. Furthermore in accordance with the invention, central contact area 72 is coextensive with gasket 128. Thus as the lid is threaded onto receptacle 22 and stopper 84 is thereby received within the lid, central contact area 72 presses against gasket 128 thus creating an airtight seal of upper orifice 123 of channel 124. At the same time annular contact ring 68 of lid 34 presses against annular flange 94 of stopper 84 to reliably seal receptacle 22 as discussed above.

As the rotor 12 rotates about its spin axis 16, the centrifuge container 10 is subjected to a centrifugal load, operating thereon in a direction parallel to the axis 18. The frusto-conical surface 50 allows the lid 34 and receptacle 22 to move toward the closed end 28 in response to the load, further tightening the seal between the gasket 54 and the cylindrical wall 26. To facilitate this movement, the tubular portion 74 is in slidable engagement with the cylindrical wall 26; and the nadir 78 is spaced-apart from the closed end 28; when placed in the final seating position and the rotor 12 is at rest. The fluid-tight and air-tight seal formed between the gasket 54 and the cylindrical wall 26 prevents leakage of a sample or air from the canister 20, were the receptacle 22 to rupture or otherwise allow the sample to egress therefrom A further advantage provided by the lid 34 is that the ribs 64 and 70, disposed thereon, amplify the force in response to centrifugal loading. Specifically, the ribs 64 and 70 are adapted to flex under centrifugal load, causing the apexes 66 and 72 to move toward the first major surface 86. The movement of the apexes 66 and 72 expands the circumference of the upper portion 44 of the peripheral member 38.

Figure 10:
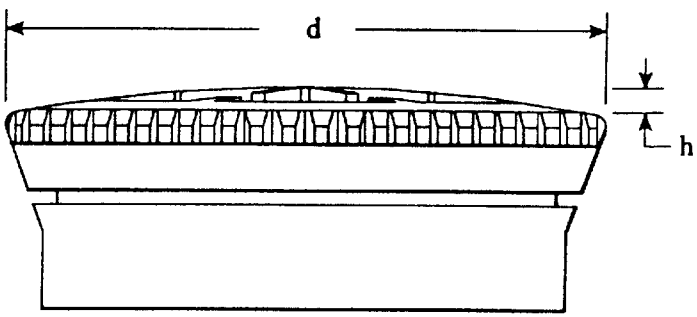
FIG. 10 is the lid shown in FIG. 9 when subjected to centrifugal loading.
Figure 9:
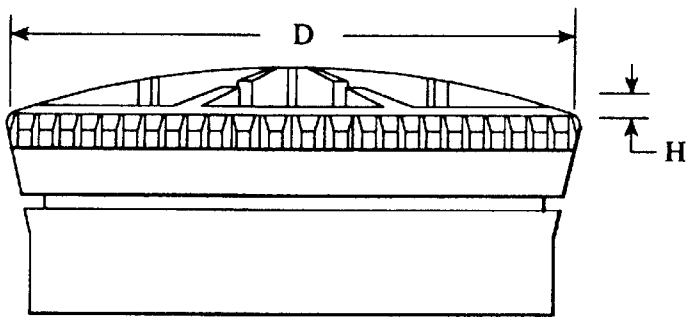
FIG. 9 is a side view of the lid shown in FIG. 3 when at rest.
Figure 12:
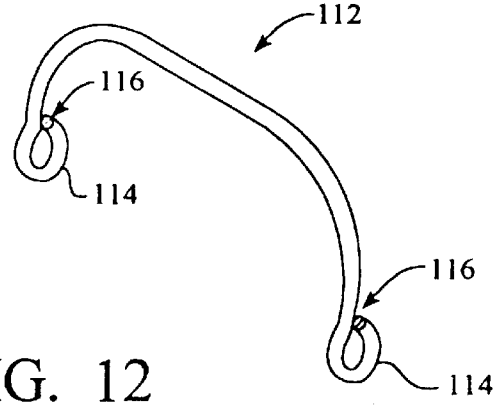
FIG. 12 is perspective view of the handle shown in FIG. 11.
Figure 11:
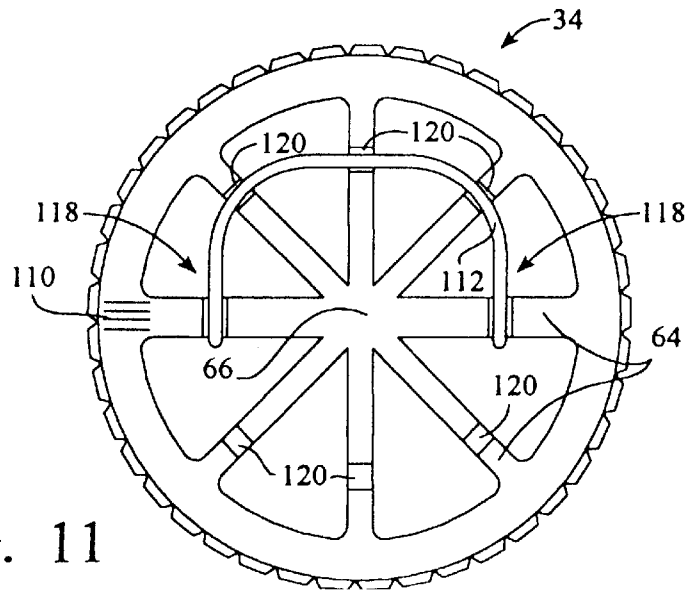
FIG. 11 is a top down view of the lid shown in FIG. 3, having a handle disposed thereon.

FIGS. 9 and 10 demonstrate the expansion of the circumference of the upper portion 44 of the peripheral member 38. The static dimensions of the lid 34 are shown in FIG. 9, when the rotor (not shown) is at rest, with the diameter of the of the peripheral member 38 being shown as D and the height of the apex 66 above the annular rim 46 shown as H. As shown in FIG. 10, during centrifugation, the height of the apex 66 above the annular rim 46 changes as a result of the centrifugal load, discussed above, so as to measure a distance h, with h<H. The aforementioned change in height results from the deflection of ribs 64 and 70. The deflection is in the range of 0.0010 to 0.0045 inch, depending upon the rotational speed of the rotor and the rotor's size. The aforementioned deflection causes a proportional change in the diameter of the peripheral member. As shown, under a centrifugal load, the diameter of the peripheral member 38 measures a distance d, with d>D. This results in an increase in the sealing force applied by the lid 34 that is proportional to the centrifugal load to which the lid 34 is subjected.

Referring again to FIGS. 2, 6A, 7 and 8, the first and second sets of ribs 64 and 70 provide a sufficient amount of resistance to the centrifugal load to maintain the void 106 between the second set of ribs 70 and the first major side 86. This focuses the compressive force applied by the lid 34 onto the area of the stopper 84 which coincides with the annular contact ring 68. That is, the compressive force of lid 34 provided by the flexure of ribs 64 and 70 is transferred to annular flange 94 of the stopper via the annular contact ring, thus ensuring a reliable seal by the stopper. Focusing the compressive force of the lid 34 to the annular flange avoids decompression of gasket 98.

The flexing of ribs 64 and 70 under a centrifugal load also ensures that central contact area 72 of lid 34 maintains an airtight seal of channel orifice 123. During centrifugation, the central region of stopper 84 will tend to flex downward due to loading by centrifugal forces. This tends to bring gasket 128 away from the central contact area of lid 34, which would break the seal. However, because of the flexure of ribs 64 and 70, central contact area 72 will also deform in the direction of stopper 84, maintaining contact with gasket 128 and thus ensure an airtight seal during centrifugation.

At the end of a centrifugation run, it has been noted above that occasionally the receptacle 22 develops a vacuum which could make difficult the removal of the stopper 84. However, in the present invention, such difficulty is overcome simply by the act of removing the lid 34 from the receptacle. As the lid 34 is unscrewed, the central contact area 72 lifts away from gasket 128 of the stopper, allowing air to pass through channel 124 thereby relieving the vacuum within receptacle 22. The stopper is now effortlessly removed as a result of the equalization of pressure between the interior of receptacle 22 and the surrounding environment.

Figure 8A:
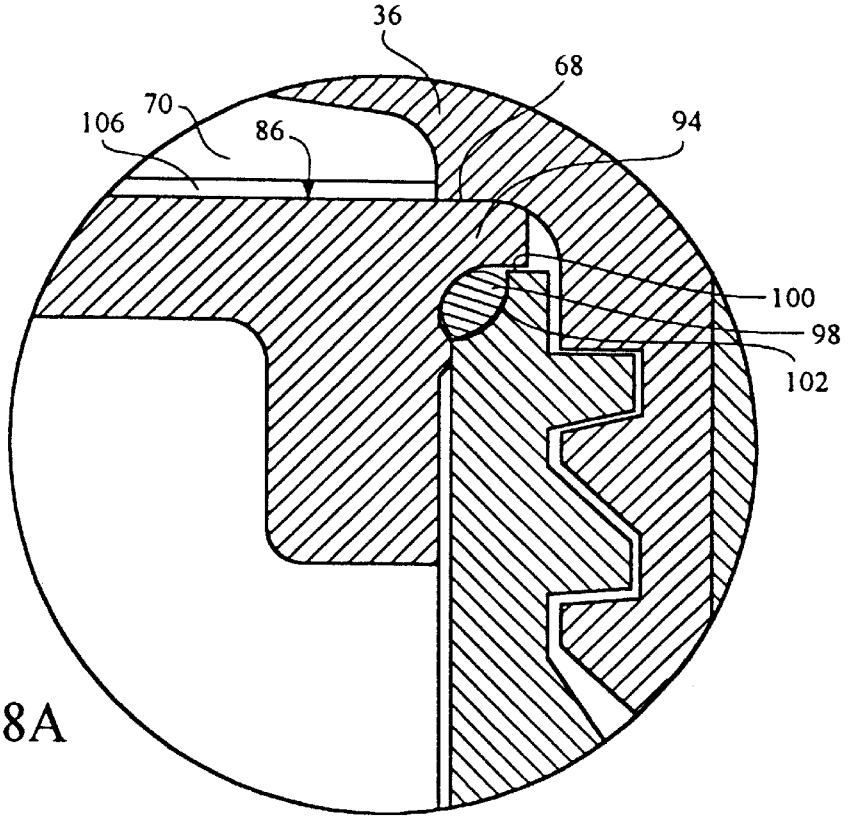
FIGS. 8A and 8B are detailed views of the container shown in FIG. 7.
Figure 8B:
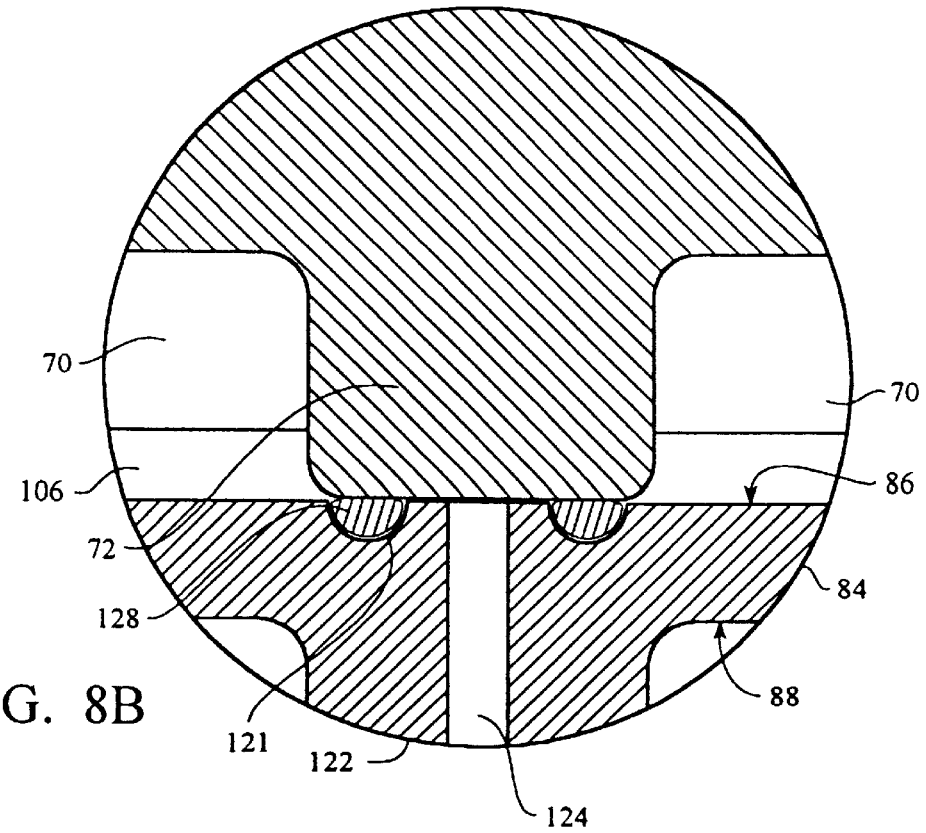

Referring to FIGS. 1 and 8A, to achieve a fluid-tight and air-tight seal between the gasket 98 and the gland 102, the receptacle 22 includes a first alignment mark 108, and the lid 34 includes a second alignment mark 110. Both the first and second alignment marks 108 and 110 are arranged so as to be axially aligned after a predetermined amount of rotational movement between the lid 34 and the receptacle 22. Although the alignment marks 108 and 110 may be indicia, in the preferred embodiment, the first alignment mark 108 consists of a recess formed into the tubular wall 74 so as to extend along a length thereof. In this design, the recess functions as a vent to allow fluid to move freely as the receptacle is being placed in, or removed from, the canister 20. This prevents a vacuum, or positive pressure, from being present between the canister 20 and the receptacle 22, thereby facilitating coupling and decopuling of the same. The second alignment mark 110 is typically a detent.

Referring to FIGS. 1, 4A, 11 and 12, additional features may be provided to facilitate coupling and decoupling of the various components of the dual vessel centrifuge container 10. For example, the lid 34 may include curved handle 112, the opposed ends of which are attached to one of the ribs 64 on opposing sides of the apex 66. The opposed ends may include circular loops 114 having a gap 116 present therein. One of the ribs 64 may include through-ways 118 in which one of the circular loops 114 is disposed. This allows the handle 112 to be rotatably attached to the lid 34, which facilitates placing the handle adjacent to the ribs 64 when not in use, shown in FIG. 11. To further reduce the drag that the handle 112 may create during centrifugation, a slot 120 may be formed into each rib 64 so as to receive the handle when placed adjacent thereto. The slots 120 may be of sufficient depth to allow the handle 112 to be disposed between the apex 66 and the annular ring 46. In addition, the flexibility of the ribs 64 and 70, shown more clearly in FIGS. 3 and 5, may be augmented by increasing either the numb or the size of the slots 120, present therein.

I claim:

1. A cap assembly for a centrifuge container, comprising:

a stopper member adapted to seal an open end of said container, said stopper member having opposed top and bottom surfaces and a closeable channel extending therethrough along a central axis thereof and having an upper orifice opening through said top surface and a lower orifice opening through said bottom surface; and a lid member adapted to removably engage said open end of said container, said lid member having opposed top and bottom surfaces, said bottom surface having downwardly depending rib members;

portions of said rib members intersecting at said central axis and coextensive with said upper orifice opening;

whereby, with said stopper member received in said open end of said container, engaging said lid member with said open end causes said downwardly depending rib members to press upon portions of said stopper member top surface and to cover said upper orifice opening, and whereby removal of said lid member separates said downwardly depending rib members from said stopper member top surface thereby uncovering said upper orifice opening.

2. The cap assembly of claim 1 wherein said channel has a varying width therealong.

3. The cap assembly of claim 1 wherein said channel has a gradually widening opening with approach to said stopper member bottom surface.

4. The cap assembly of claim 1 wherein said channel includes a filter element along its path.

5. The cap assembly of claim 1 wherein said stopper member bottom surface includes a boss disposed about said central axis, said channel passing through said boss.

6. The cap assembly of claim 5 further including a gasket member disposed about said upper orifice opening.

7. A closure system for sealing a centrifuge container, comprising:

a lid having an interior region for receiving an open end of said container and adapted to releasably engage said open end; and an inner stopper having a flanged rim, said flanged rim including a rim portion to be received in said open end and a flanged portion to rest upon a portion of an upper surface of said open end;

said inner stopper having opposed top and bottom surfaces and a fluid passage extending therebetween, said fluid passage having an opening through both said top and bottom surfaces, said top surface opening having a first fluid-tight sealing element disposed therearound;

said interior region of said lid having rib members formed therein, portions of said rib members dimensioned to press against said top surface of said inner stopper so that said inner stopper is tightly pressed against said open end of said container when said lid has engaged said container;

said portions of said rib members being coextensive with said first fluid-tight sealing element and aligned for engagement therewith, thereby providing a fluid-tight seal to prevent fluidic flow through said top surface opening.

8. The closure system of claim 7 wherein said fluid passage is coaxial with the central axis of said inner stopper.

9. The closure system of claim 7 further including a filter element disposed in-line with said fluid passage.

10. The closure system of claim 7 wherein said fluid passage widens with approach to said bottom surface of said inner stopper.

11. The closure system of claim 7 wherein said bottom surface of said inner stopper includes a boss member, said fluid passage extending through said boss member and having an opening though a bottom of said boss member.

12. The closure system of claim 7 wherein said inner stopper further includes a second fluid-tight sealing element circumferentially disposed about said rim portion and on the underside of said flange portion, said rim portion having a circumferentially disposed ridge for retaining said second fluid-tight sealing element in position.

* * * * *